US007381234B2

(12) United States Patent
Oh

(10) Patent No.: US 7,381,234 B2
(45) Date of Patent: Jun. 3, 2008

(54) DUST COLLECTING APPARATUS FOR VACUUM CLEANER

(75) Inventor: Jang-keun Oh, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 11/647,071

(22) Filed: Dec. 28, 2006

(65) Prior Publication Data

US 2007/0289264 A1 Dec. 20, 2007

Related U.S. Application Data

(60) Provisional application No. 60/814,332, filed on Jun. 16, 2006.

(30) Foreign Application Priority Data

Jul. 24, 2006 (KR) ..... 10-2006-0069382

(51) Int. Cl.
*B01D 50/00* (2006.01)

(52) U.S. Cl. ..... 55/318; 55/337; 55/346; 55/349; 55/429

(58) Field of Classification Search ..... 55/DIG. 3, 55/DIG. 14, 318, 337, 345, 346, 349, 428, 55/429, 434, 452, 459.1, 465; 96/415, 416
See application file for complete search history.

(56) References Cited

U.S. PATENT DOCUMENTS 6,238,451 B1 5/2001 Conrad et al. ..... 55/323
6,436,160 B1 * 8/2002 Stephens et al. ..... 55/337
D462,489 S * 9/2002 Roberts et al. ..... D32/31

(Continued)

FOREIGN PATENT DOCUMENTS

JP 2004-267680 9/2004

(Continued)

OTHER PUBLICATIONS

PCT International Search Report and Written Opinion dated May 3, 2007 corresponding to International Patent Application No. PCT/KR2007/000508.

(Continued)

*Primary Examiner*—Duane Smith
*Assistant Examiner*—Sonji Turner
(74) *Attorney, Agent, or Firm*—Ohlandt, Greely, Ruggiero & Perle, LLP.

(57) ABSTRACT

Disclosed is a dust collecting apparatus is provided that includes a dust canister body, a part of which becomes an exposed side exposed outside a cleaner body. The cleaner body has a first dust separating chamber for separating large-sized dirt and second dust separating chamber for collecting fine dust; a cyclone body having a cyclone chamber which separates the fine dust from the air passing through the first dust separating chamber; and an outlet pipe protruding from lower surfaces of the first and second cyclone bodies to upper sides of the first and second cyclone chambers, wherein at least a part of the exposed side of the dust canister body is made of a transparent material so as to simultaneously see through the first and second dust separating chambers, and at least a part of the cyclone body is made of the transparent material to see through the cyclone body.

8 Claims, 4 Drawing Sheets

U.S. PATENT DOCUMENTS

| | | | | | |
|---|---|---|---|---|---|
| D468,069 | S | * | 12/2002 | Roberts et al. | D32/31 |
| D469,226 | S | * | 1/2003 | Stephens | D32/31 |
| 6,524,358 | B2 | * | 2/2003 | Yang | 55/337 |
| D477,443 | S | * | 7/2003 | Kondo et al. | D32/21 |
| 6,613,129 | B2 | * | 9/2003 | Gen | 95/269 |
| 6,740,144 | B2 | | 5/2004 | Conrad et al. | 96/57 |
| 6,746,500 | B1 | * | 6/2004 | Park et al. | 55/343 |
| D494,718 | S | * | 8/2004 | Rosenzweig et al. | D32/31 |
| D494,719 | S | * | 8/2004 | Rosenzweig et al. | D32/31 |
| D498,886 | S | * | 11/2004 | Fujii | D32/21 |
| 6,840,972 | B1 | * | 1/2005 | Kim | 55/337 |
| 6,859,975 | B2 | * | 3/2005 | Ohta et al. | 15/347 |
| 6,922,868 | B1 | | 8/2005 | Jeong | 15/353 |
| 7,097,680 | B2 | * | 8/2006 | Oh | 55/343 |
| D528,721 | S | * | 9/2006 | Santiago et al. | D32/31 |
| D529,247 | S | * | 9/2006 | Carlito | D32/31 |
| 2006/0090428 | A1 | * | 5/2006 | Park et al. | 55/337 |
| 2006/0137304 | A1 | * | 6/2006 | Jeong et al. | 55/337 |
| 2006/0277874 | A1 | * | 12/2006 | Yoo | 55/429 |

FOREIGN PATENT DOCUMENTS

| | | | |
|---|---|---|---|
| JP | 2005-102893 | | 4/2005 |
| KR | 1020020072007 | | 9/2002 |
| KR | 1020050108623 | A | 11/2005 |
| KR | 1020060031446 | A | 4/2006 |
| KR | 1020060037989 | A | 5/2006 |

OTHER PUBLICATIONS

International Search Report dated May 3, 2007 from the corresponding PCT Patent Application No. PCT/KR2007/000509.

* cited by examiner

DUST COLLECTING APPARATUS FOR VACUUM CLEANER

CROSS-REFERENCE TO RELATED APPLICATIONS

This application claims the benefit of U.S. Provisional Application No. 60/814,332 filed on Jun. 16, 2006 in the United States Patent and Trademark Office, and the benefit of Korean Patent Application No. 10-2006-0069382 filed on Jul. 24, 2006 in the Korean Intellectual Property Office, the entire disclosures of which are incorporated herein by reference.

BACKGROUND OF THE INVENTION

1. Field of the Invention

The present disclosure relates to a dust collecting apparatus for a vacuum cleaner, and more particularly to a dust collecting apparatus which can separate large-sized dirt and fine dust through a multi-stage process in twice.

2. Description of the Related Art

A dust collecting apparatus provided in a vacuum cleaner is to separate dirt and dust from drawn-in external air. Recently, a so-called cyclone dust collecting apparatus, which does not use a dust envelope and can be used semipermanently is used widely. In the dust collecting apparatus, the dust contained in the drawn-in air is separated due to a difference in centrifugal force between the air and the dust by rotating the air.

A conventional dust collecting apparatus in which the dust contained in the drawn-in air is separated through a multi-stage process is disclosed in Korean Laid-Open Patent Publication No. 2000-0074149. The conventional dust collecting apparatus has a two-divided structure that the dust is separated firstly in a first dust collecting chamber by using the force of gravity and then separated secondarily in a second dust collecting chamber by using the centrifugal force. Also, the dust collecting apparatus has a separate filter between the first and second dust collecting chambers.

However, in the conventional dust collecting apparatus, since an air suction part of the first dust collecting chamber and an exhaust part of the second cyclone dust collecting chamber are positioned collinearly, there is a disadvantage that it can not be expected to obtain proper dust collecting efficiency without the filter. Further, there is another problem in that the filter should be periodically cleaned so that the dust and dirt attached on the filter can be removed, since the dust and dirt is attached and accumulated on the filter.

Further, since the conventional dust collecting apparatus has a single cyclone chamber and thus has a suction and exhaust flow path having a narrow sectional area, it can not be expected to obtain a high suction force and it is also apparent that the suction force is further lowered when the filter is choked up with the dust and dirt.

Furthermore, in the conventional dust collecting apparatus, since the first and second dust collecting chambers are not visible from the outside, when the dirt drawn-in in the dust collecting apparatus has a large size, the user can not know where the large-sized dirt is caught in the collecting apparatus. In order to check where the large-sized dirt is caught in the collecting apparatus, the user has to stop the operation of the vacuum cleaner and separate the dust collecting apparatus from a cleaner body and open a cover and then check the inside of the dust collecting apparatus.

SUMMARY OF THE INVENTION

The present disclosure has been developed in order to solve the above and other problems associated with the related art. A feature of the present disclosure is to provide a dust collecting apparatus which can improve a dust separating efficiency without a filter disposed between a dirt separating chamber in which dirt is separated primarily and a cyclone chamber in which fine dust is separated secondarily.

Another feature of the present disclosure is to provide a dust collecting apparatus which can prevent a back flow of the collected dirt and dust from the cyclone chamber.

Yet another feature of the present disclosure is to provide a dust collecting apparatus which can ensure visibility for observing the dust separating chamber and the cyclone chamber disposed in the dust collecting apparatus from the outside even during the operation of the vacuum cleaner without separating the dust collecting apparatus from the vacuum cleaner.

In order to achieve a feature of the present disclosure, there is provided a dust collecting apparatus which is detachably coupled with a vacuum cleaner, comprising a dust canister body, a part of which becomes an exposed side exposed outside a cleaner body upon mounting in the cleaner body, and which comprises a first dust separating chamber for separating large-sized dirt from air flowed in through an inlet port formed at one side thereof by using inertia and gravity, and second dust separating chamber, which is isolated from the first dust separating chamber, for collecting fine dust from the air passing through the first dust separating chamber; a cyclone body having a cyclone chamber which is communicated with the first dust separating chamber and separates the fine dust from the air passing through the first dust separating chamber by using centrifugal force generated when the air is rotated; and an outlet pipe which is protruded from lower surfaces of the first and second cyclone bodies to upper sides of the first and second cyclone chambers, wherein at least a part of the exposed side of the dust canister body is made of a transparent material so as to simultaneously see through the first and second dust separating chambers, and at least a part of the cyclone body is made of the transparent material to see through the cyclone body.

Preferably, the cyclone body may be eccentrically arranged within the second dust separating chamber so as to form a protruded portion protruded from the exposed side of the dust canister body, and at least the protruded portion is made of the transparent material so as to see through the cyclone body.

Preferably, the cyclone body may be eccentrically arranged within the second dust separating chamber so as to form a common portion contacted with a portion of the exposed side of the dust canister body, and at least the common portion is made of the transparent material to see through the first and second cyclone chambers.

Preferably, the first and second dust separating chambers are isolated from each other by a partition wall, and at least a part of the partition wall is made of the transparent material so as to increase visibility.

Preferably, the first dust separating chamber is provided with an inertia blocking plate which is arranged at a position corresponding to the inlet port of the dust canister body so that the dirt flowed through the inlet port in the first dust separating chamber is collided with the inertia blocking plate at an early stage that the air is flowed in the first dust separating chamber and then fallen down by gravity. Herein, the inertia blocking plate is protruded from an inner circumference of the first dust separating chamber and then bent to a gravity direction.

Preferably, the inertia blocking plate is protruded to an outside of the first dust separating chamber, and the inlet port is formed at a side of the inertia blocking plate.

Preferably, the cyclone chamber further comprises a spiral guide for increasing rotational force of the air flowed in the cyclone chamber, and the spiral guide is tinted with a brighter color than the cyclone body in order to clearly see the dirt flowed in the cyclone body.

Preferably, the dust collecting apparatus further comprises a cover detachably coupled with an upper side of the dust canister body so as to close and open an inside of the dust canister body, and a dust exhaust port, through which the dust can be moved, is formed between an upper side of the cyclone body and a lower side of the cover, and thus the air containing the dust is flowed from a side of the cyclone body and rotated and risen in the cyclone chamber and then exhausted through the dust exhaust port to the second dust separating chamber.

BRIEF DESCRIPTION OF THE DRAWINGS

The above aspects and features of the present disclosure will be more apparent by describing certain embodiments of the present disclosure with reference to the accompanying drawings, in which.

DETAILED DESCRIPTION OF THE PREFERRED EMBODIMENTS

Certain embodiments of the present disclosure will be described in greater detail with reference to the accompanying drawings.

Figure 1:
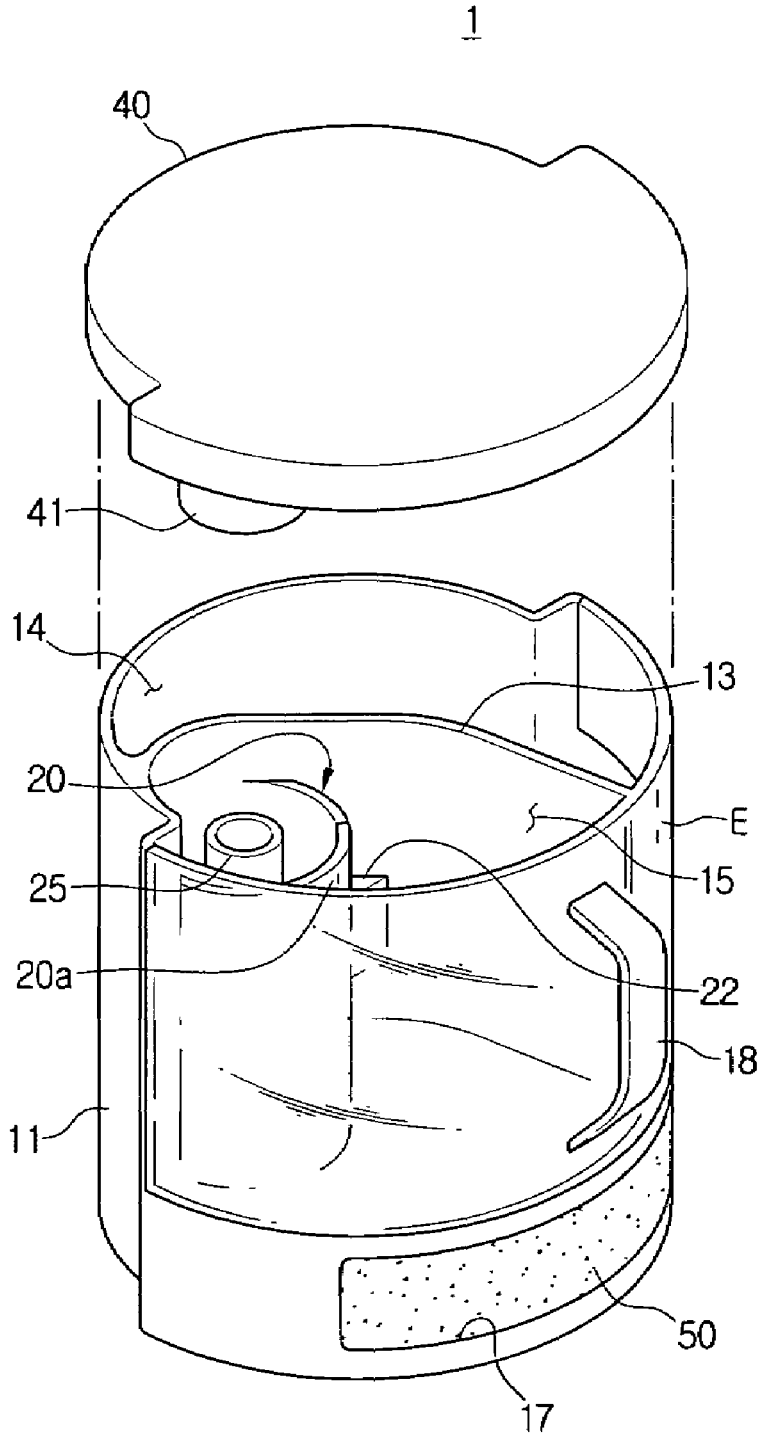
FIG. 1 is a perspective partially disassembled view of a dust collecting apparatus for a vacuum cleaner according to a first embodiment of the present disclosure.
Figure 2:
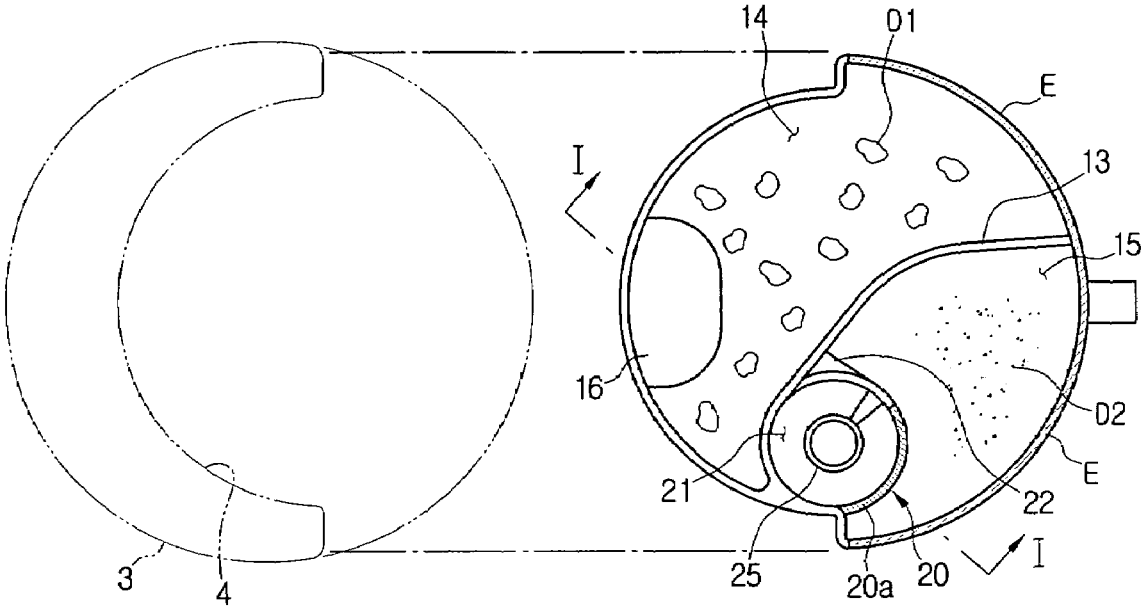
FIG. 2 is a plan view of the dust collecting apparatus in which a cover shown in FIG. 1 is removed.
Figure 3:
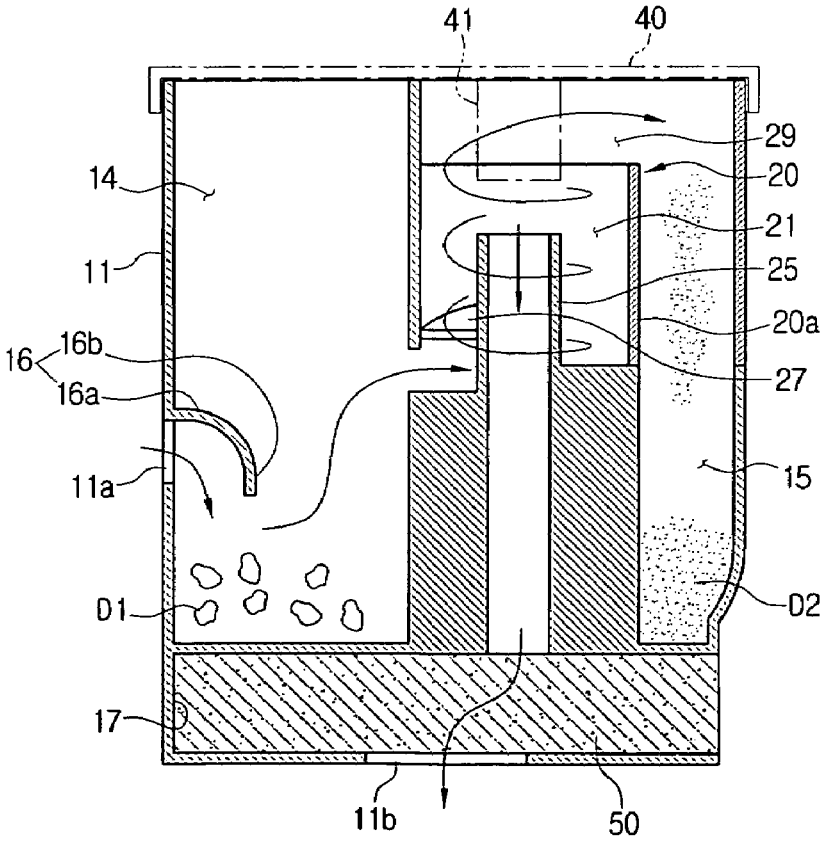
FIG. 3 is a cross-sectional view taken along a line I-I of FIG. 2.

FIG. 1 is a perspective view of a dust collecting apparatus for a vacuum cleaner according to a first embodiment of the present disclosure, FIG. 2 is a plan view of the dust collecting apparatus in which a cover shown in FIG. 1 is removed and FIG. 3 is a cross-sectional view taken along a line I-I of FIG. 2.

As shown in FIGS. 1 and 2, the dust collecting apparatus 1 according to the first embodiment of the present disclosure includes a dust canister body 11, first and second dust separating chambers 14 and 15, an inertia blocking plate 16, a cyclone body 20 and a cover 40.

As shown in FIG. 3, when a rear side of the dust canister body 11 is disposed at a concaved part 4 of a cleaner body 3, a front side of the dust canister body 11 becomes an exposed side E which is exposed to the outside of the cleaner body 3. The dust canister body 11 is formed with an inlet port 11*a*, through which air is flowed in, at the rear side thereof. In this case, the inlet port 11*a* is connected with a suction brush (not shown) of the vacuum cleaner so as to function as a path for guiding the external air containing the dust and dirt to the first dust separating chamber 14. Further, the dust canister body 11 has a handle 18 at the exposed side E so as to attach or detach the dust collecting apparatus 1 to/from the concaved part 4 of the cleaner body 3. Furthermore, a filter inserting slot 17 through which a filter 50 is inserted is formed at a lower side of the dust canister body 11. In this case, an upper side of the filter inserting slot 17 is communicated with a lower end of an outlet pipe 25 to be disclosed later, and a lower side thereof is formed with an outlet port 11*b* through which the air passing through the outlet pipe 25 and the filter 50 is exhausted. The filter 50 serves to filter again the cleaned air in which the dirt and dust is separated in the first dust separating chamber 14 and the cyclone body 20. In the embodiment, the dust collecting apparatus 1 can be used even in a status that the filter 50 is removed from the filter inserting slot 17.

The first and second dust separating chambers 14 and 15 are divided to be isolated from each other in the dust canister body 11. In this case, the first and second dust separating chambers 14 and 15 are isolated by a first partition wall 13 which divides an inner space of the dust canister body 11 into a right space and a left space. Herein, since the first dust separating chamber 14 collects large-sized dirt, the first dust separating chambers 14 may by formed to have a larger space than the second dust separating chamber 15. Further, the whole or a part of the exposed side E of the dust canister body 11 is made of a transparent material so as to check an amount of the dirt and dust collected in the first and second dust separating chambers 14 and 15 at the same time.

Furthermore, the first dust separating chamber 14 is communicated with the inlet port 11*a*, and the inertia blocking plate 16 is formed to be protruded to the inside of the first dust separating chamber 14 at a position corresponding to the inlet port 11*a*. In this case, the first dust separating chamber 14 is the space for primarily collecting large-sized dirt D1 separated from the air drawn-in through the inlet port 11*a* by using the inertia blocking plate 16. The detailed description of the inertia blocking plate 16 will be provided later. The second cyclone body 20 in which the drawn-in air is rotated and risen up to generate centrifugal force and thus the fine dust D2 is separated from the drawn-in air by the centrifugal force is eccentrically disposed inside the second dust separating chamber 15. Therefore, the fine dust D2 separated by the cyclone body 20 is collected in the second dust collecting chamber 15. Meanwhile, in the dust collecting apparatus 1 according to the first embodiment, the large-sized dirt D1 is separated primarily from the drawn-in air in the first dust separating chamber 14 by the inertia blocking plate 16, and the fine dust D2 is separated secondarily by the cyclone body 20, and the separated fine dust D2 is collected in the second dust separating chamber 15.

As shown in FIG. 3, one end 16*a* of the inertia blocking plate 16 is connected around the inlet port 11*a*, and the other end 16*b* is protruded to the inside of the first dust separating chamber 14 by a desired distance and then bent in the gravity direction. The other end 16*b* of the inertia blocking plate 16 is disposed to be correspondent with a moving direction of the large-sized dirt D1 flowed in through the inlet port 11*a*, and at the same time, is formed to have a larger area than the inlet port 11*a*. Therefore, the large-sized dirt D1 flowed with the air through the inlet port 11*a* in the first dust separating chamber 14 is continuously moved through inertia in an initial moving direction at the early stage and fallen down by gravity after colliding with the inertia blocking plate 16 and then collected in the first dust separating chamber 14.

The cyclone body 20 is provided with the cyclone chamber 21 in which the drawn-in air and the dirt contained the air are rotated, and also includes an air inlet path 22, an outlet pipe 25 and a spiral guide 27. One end of the air inlet path 22 is communicated with the first dust separating chamber 14 and the other end is communicated with the cyclone chamber 21 so that the air inlet path 22*a* serves to guide the air flowed in the first dust separating chamber 14 to the cyclone chamber 21. Preferably, the one end of the air inlet path 22, which is communicated with the first dust separating chamber 14, is formed at a higher position than the inlet port 11*a* of the dust canister body 11 so that the drawn-in air through the inlet port 11*a* is not directly flowed in the air inlet path 22. This is to ensure an enough time and distance to separate the large-sized dirt D1 from the air passing through the inlet port 11*a* so that the large-sized dirt D1 which is not separated from the air yet is prevented previously from being flowed in the cyclone chamber 21. The outlet pipe 25 through which the cleaned air is exhausted is protruded vertically to an upper side of the cyclone chamber 21. Further, a dust exhaust port, 29 through which the dust can be moved, is formed between an upper side of the cyclone body 20 and a lower side of the cover 40. Therefore, the dust is exhausted through the dust exhaust port 29 to the second dust separating chamber 15 by centrifugal force of the air which is rotated and risen in the cyclone chamber 21. Since the cyclone chamber 21 and the second dust separating chamber 15 are arranged in parallel and also isolated from each other, once the dirt or dust is moved to the second dust separating chamber 15, it would be never flowed back to the cyclone chamber 21.

The spiral guide 27 has a spiral structure that starts from a portion communicated with the air inlet path 22 and rises up while rounding an outer circumference of the outlet pipe 25. The spiral guide 27*a* functions to guide the air flowed in through the air inlet path 22 so that the air is risen up while being rotated around the outlet pipe 25. The outlet pipe 25 serves as a liner path through which the cleaned air in the cyclone chamber is exhausted to the outside of the dust collecting apparatus 1 and also as a central axis around which the air flowed through the air inlet path 22 in the cyclone chamber 21 is rotated.

As shown in FIGS, 1 and 2, the cyclone body 20 is disposed eccentrically at the rear side of the dust canister body 11. Herein, the whole or a part 20*a* of the cyclone body 20 and the exposed side E of the dust canister body 11 may be formed of a transparent body so that the user can see the inside of the cyclone body 20 without separating the dust collecting apparatus 1 from the cleaner body 3 even during the operation of the vacuum cleaner. Therefore, the user can see the dirt flowed through the spiral guides 27 in the cyclone chambers 21 with the naked eye by using the transparent dust canister body 11 and cyclone body 20. For example, when the large-sized dirt is jammed in the spiral guide 27 of the cyclone chambers 21, the user can fix it all right promptly. Therefore, it is possible to previously prevent pressure loss in the cyclone chambers 21. In this case, in order to further clearly find the dirt flowed in the cyclone chamber 21 with the naked eye, the spiral guide 27 may be tinted with a brighter color than the cyclone body 20.

As shown in FIG. 3, the cover 40 is detachably disposed at the upper side of the dust canister body 11 to be apart from the cyclone body 20 at a desired distance. Also the cover 40 is closely coupled with the upper side of the dust canister body 11 to close up the first and second dust separating chambers 14 and 15. A rotation guide member 41 is protruded at a lower surface of the cover 40, and a setting position of the rotation guide member 41 on the cover 40 is determined so that the rotational guide member 41 is inserted into a center portion of the cyclone chamber 21 when the cover 40 is coupled to the dust canister body 11. In the embodiment, the rotational guide member 41 is formed into a pipe and functions to keep and increase a rotational force of the dirt which is rotated and risen up toward the dust exhaust port 29 formed between the lower surface of the cover 40 and the cyclone body 20, thereby improving an exhaust efficiency to the dust exhaust port 29. According to the present disclosure as described above, it is prevented that the dirt and dust collected in the first and second dust separating chambers 14 and 15 is stirred up or spilled out while the dust collecting apparatus 1 is separated from the cleaner body 3 and then moved to a place for dumping the dirt and dust.

Figure 4:
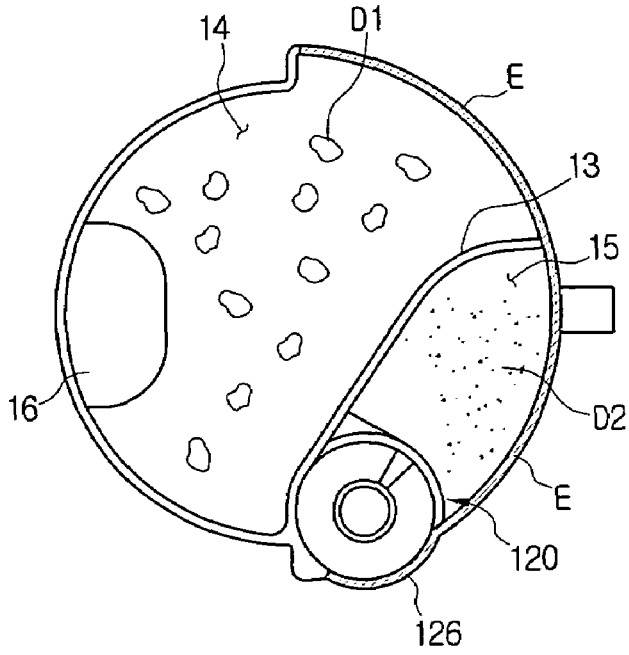
FIG. 4 is a plan view of the dust collecting apparatus for vacuum cleaner according to a second embodiment of the present disclosure.

FIG. 4 a plan view of the dust collecting apparatus for vacuum cleaner according to a second embodiment of the present disclosure.

As shown in FIG. 4, the dust collecting apparatus according to the second embodiment has the same structure as in the first embodiment except a fact that a part of the cyclone body 120 is eccentrically disposed at the second dust separating chambers 15 so as to be protruded from the dust canister body 11 to the outside. That is, the cyclone body 120 is eccentrically disposed at one side of the second dust separating chamber 15 so as to have a protruded portion 126. Preferably, the protruded portion 126 is formed of the transparent material so that the user can see through the cyclone body 120. In this case, since the dust collecting apparatus 1 has the protruded portion 126, the dust collection chamber 11 can ensure availability of a space for collecting the dust into the dust collection chamber 11 as a space corresponding to the protruded portion 126. Therefore, it is possible to make the second dust collection chamber 15 to be larger without increasing the size of the dust canister body 11, which results in maintaining the dust collecting apparatus in compact.

Meanwhile, in the second embodiment, since the first dust separating chamber 14 collects large-sized dirt, the first dust separating chambers 14 may by formed to have a larger space than the second dust separating chamber 15, as shown in FIG. 4.

Figure 5:
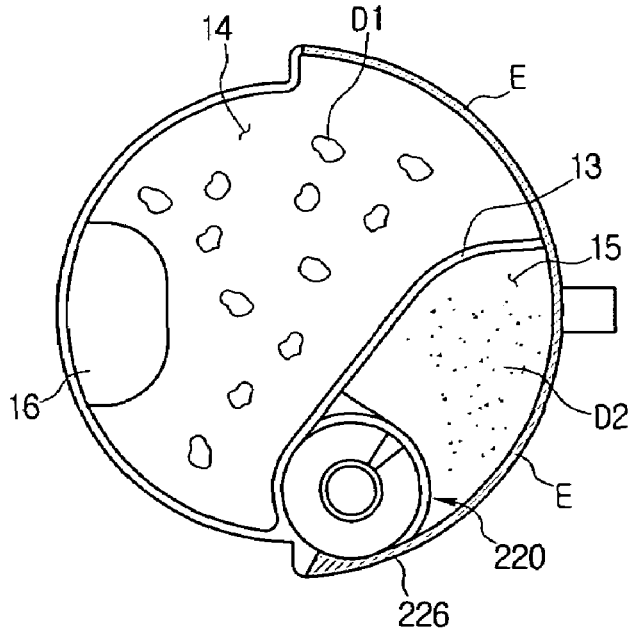
FIG. 5 is a plan view of the dust collecting apparatus for vacuum cleaner according to a third embodiment of the present disclosure.

FIG. 5 is a plan view of the dust collecting apparatus for vacuum cleaner according to a third embodiment of the present disclosure.

As shown in FIG. 5, the dust collecting apparatus according to the third embodiment has the same structure as in the first embodiment except a position that the cyclone body 220 is eccentrically disposed in the second dust separating chamber 15. That is, the cyclone body 220 is eccentrically disposed at one side of the second dust separating chamber 15 so as to have a common portion 226 which is integrally contacted with the exposed side E of the dust canister body 11.

Therefore, in the second and third embodiment, since the cyclone body 120, 220 is not apart from the exposed side E of the dust canister body 11 by having the protruded portion 126 or the common portion 226, it is prevent that the cyclone body 120, 220 is invisible by the collected dust and dirt. Therefore, the user can see more clearly the flow of the dirt or dust within the cyclone body 120, 220 than in the first embodiment.

Figure 6:
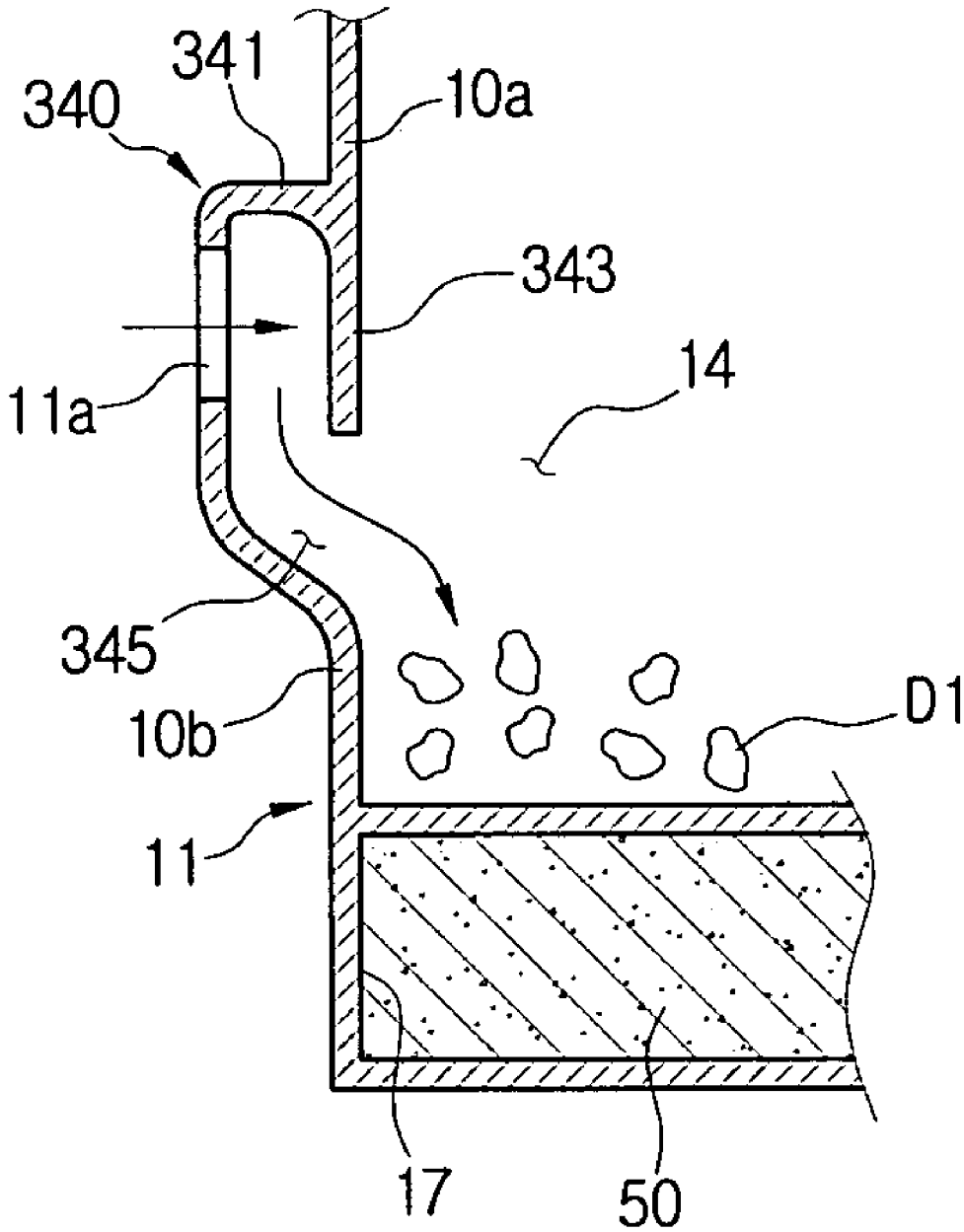
FIG. 6 is a partial cross-sectional view of the dust collecting apparatus for vacuum cleaner according to a fourth embodiment of the present disclosure

FIG. 6 is a partial cross-sectional view of the dust collecting apparatus for vacuum cleaner according to a fourth embodiment of the present disclosure.

As shown in FIG. 6, the dust collecting apparatus according to the fourth embodiment has the same structure as in the first embodiment except the fact that a part 341 of the inertia blocking plate 230 is protruded to the outside of the dust canister body 11. That is, the part 341 of the inertia blocking plate 340 is protruded to the outside of the dust canister body 11 and formed with the inlet port 11*a*, and the other part 343 is formed to be extended vertically from an outer wall 10*a* of the dust canister body 11. At this time, a lower end of the other part 343 is apart from an outer wall 10*b* of the canister body 11 at a desired distance so as to form an inlet path 345 through which the air passing through the inlet port 11*a* is flowed in the first dust separating chamber 14.

In the fourth embodiment as described above, when the dust canister body 11 is tilted so as to remove the dirt and dust collected in the first dust separating chamber 14, it is prevented that the discharged dirt and dust is caught by the inertia blocking plate 340, whereas the dirt and dust can be discharged facilely.

According to the present disclosure as described above, since the dust collecting apparatus is provided with the inertia blocking plate for separately collecting large-seized dirt, and the cyclone chamber and the dust separating chamber are disposed in parallel to be isolated from each other, it is possible to improve dust collecting efficiency without a separate filter.

Further, since the cyclone chamber and the second dust separating chamber are arranged in parallel and isolated from each other, once the dirt or dust is moved to the second dust separating chamber, it would be never flowed back to the cyclone chamber.

Furthermore, since the cyclone chamber has visibility for observing the inside thereof from the outside so that the user can see the flow of the dirt and dust with the naked eye during the operation of the vacuum cleaner, when the large-sized dirt is jammed in the cyclone chamber, the user can fix it all right promptly. Therefore, it is possible to previously prevent pressure loss in the dust collecting apparatus and thus prevent lowering of the suction force. Further, the user can get hold of the amount of dirt and dust collected in the first to third dust separating chambers without separating the dust collecting apparatus from the vacuum cleaner and thus can know easily when the collected dirt and dust should be removed.

In addition, since the cyclone body is formed to be protruded from the dust canister body to the outside and thus the space for collecting the dirt and dust is increased, it is possible to increase a period for dumping the collected dirt and dust.

The foregoing embodiment and advantages are merely exemplary and are not to be construed as limiting the present disclosure. The present teaching can be readily applied to other types of embodiments. Also, the description of the embodiments of the present disclosure is intended to be illustrative, and not to limit the scope of the claims, and many alternatives, modifications, and variations will be apparent to those skilled in the art.

What is claimed is:

1. A dust collecting apparatus which is detachably coupling with a vacuum cleaner, comprising:

a dust canister body, a part of which becomes an exposed side exposed outside a cleaner body upon mounting in the cleaner body, and which comprises a first dust separating chamber for separating large-sized dirt from air flowed in through an inlet port formed at one side thereof by using inertia and gravity, and a second dust separating chamber, which is isolated from the first dust separating chamber, for collecting fine dust from the air passing through the first dust separating chamber;

a cyclone body having a cyclone chamber which is in fluid communication with the first dust separating chamber and separates the fine dust from the air passing through the first dust separating chamber by using centrifugal force generated when the air is rotated; and an outlet pipe which is protruded from a lower surface of the cyclone body to an upper side of the cyclone chamber, wherein at least a part of the exposed side of the dust canister body is made of a transparent material so as to simultaneously see through the first and second dust separating chambers, and at least a part of the cyclone body is made of the transparent material to see through the cyclone body, and wherein the first dust separating chamber is provided with an inertia blocking plate which is arranged at a position corresponding to the inlet port of the dust canister body so that the dirt flowed through the inlet port in the first dust separating chamber collides with the inertia blocking plate.

2. The apparatus according to claim 1, wherein the cyclone body is eccentrically arranged within the second dust separating chamber so as to form a protruded portion protruded from the exposed side of the dust canister body, and at least the protruded portion is made of the transparent material so as to see through the cyclone body.

3. The apparatus according to claim 1, wherein the cyclone body is eccentrically arranged within the second dust separating chamber so as to form a common portion contacted with a portion of the exposed side of the dust canister body, and at least the common portion is made of the transparent material to see through the cyclone chamber.

4. The apparatus according to claim 1, wherein the first and second dust separating chambers are isolated from each other by a partition wall, and at least a part of the partition wall is made of the transparent material.

5. The apparatus according to claim 1, wherein the inertia blocking plate protrudes from an inner circumference of the first dust separating chamber and then bends in a gravity direction.

6. The apparatus according to claim 1, wherein the inertia blocking plate is protrudes to an outside of the first dust separating chamber, and the inlet port is formed at a side of the inertia blocking plate.

7. The apparatus according to claim 1, wherein the cyclone chamber further comprises a spiral guide for increasing rotational force of the air flowing in the cyclone chamber, and the spiral guide is tinted with a brighter color than the cyclone body in order to clearly see the dirt flowing in the cyclone body.

8. The apparatus according to claim 1, further comprising a cover detachably coupled with an upper side of the dust canister body so as to close and open an inside of the dust canister body, and wherein a dust exhaust port, through which the dust can be moved, is formed between an upper side of the cyclone body and a lower side of the cover, and thus the air containing the dust is flowed from a side of the cyclone body and rotated and risen in the cyclone chamber and then exhausted through the dust exhaust port to the second dust separating chamber.

* * * * *